US005558538A

United States Patent [19]

Delalle

[11] Patent Number: 5,558,538

[45] Date of Patent: Sep. 24, 1996

[54] TERMINATION DEVICE AND METHOD

[75] Inventor: Jacques Delalle, Triel-Sur-Seine, France

[73] Assignee: Raychem S.A., France

[21] Appl. No.: 397,143

[22] PCT Filed: Sep. 3, 1993

[86] PCT No.: PCT/GB93/01865

§ 371 Date: Mar. 13, 1995

§ 102(e) Date: Mar. 13, 1995

[87] PCT Pub. No.: WO94/07282

PCT Pub. Date: Mar. 31, 1994

[30] Foreign Application Priority Data

Sep. 14, 1992 [GB] United Kingdom ..... 9219448

[51] Int. Cl.[6] ..... H01R 9/05

[52] U.S. Cl. ..... 439/583; 439/932; 29/828

[58] Field of Search ..... 439/583, 585, 439/578, 932, 610, 394; 174/87; 29/828, 860, 861, 859

[56] References Cited

U.S. PATENT DOCUMENTS 4,454,376 6/1984 Holder et al. ..... 174/87

FOREIGN PATENT DOCUMENTS 0330357 8/1989 European Pat. Off. .

2841143 3/1979 Germany .

WO87/05447 9/1987 WIPO .

WO92/00616 1/1992 WIPO .

*Primary Examiner*—P. Austin Bradley

*Assistant Examiner*—Yong Kim

*Attorney, Agent, or Firm*—Herbert G. Burkard; Sheri M. Novack

[57] ABSTRACT

A device for terminating a cable having a screen and at least one inner conductor comprises:

(i) a hollow electrically conductive outer body for terminating the screen of the cable, which has two open ends and which is provided with an internal screw thread that tapers from one of its open ends;

(ii) a metallic coil, at least part of which is screwed into the tapering screw thread of the outer body and tapers towards a constriction at least when screwed into the tapering screw thread; and (iii) a conformable metallic foil in tubular form, at least part of which is located within the constriction of the metallic coil;

the device being arranged so that the screen of the cable may be terminated by inserting an exposed portion of it into the tube of metallic foil and screwing the metallic coil further into the outer body by means of the tapering screw thread, thereby constricting the coil further and causing the metallic foil to tighten about the cable screen.

16 Claims, 3 Drawing Sheets

TERMINATION DEVICE AND METHOD

This invention relates to the termination of screened cables, including coaxial cables and screened wires.

The need to match the characteristic impedance of a signal transmission cable with the nominal impedance of the cable's termination is well known. Impedance mismatch typically produces reflections of the transmitted signal, resulting in undesirable signal attenuation and the production of echos which transmit false information.

In an effort to produce impedance-matched terminations of signal transmission cables, a variety of termination methods have been used, the most common of which involve crimping, clamping and/or soldering. For example, U.S. Pat. No. 3,541,495 discloses a connector for terminating a coaxial cable, having an outer contact body for terminating the cable braid. The outer contact body is provided with a window which is covered by a heat-recoverable sleeve, and located between the sleeve and the window is a ring of solder. In order to terminate the braid of a coaxial cable inserted into the device, the heat-recoverable sleeve is heated, causing the solder to melt and form a connection between the braid and the outer contact body. Whilst this type of connector may be used to form reliable terminations of coaxial cables, it is prone to impedance mismatch, because the internal diameter of the outer contact body of the connector inevitably has to be greater than the external diameter of the cable braid, in order to enable ease of insertion of the cable. The characteristic impedance of a coaxial cable is dependant upon the ratio between the diameter of the outer conductor and the diameter of the inner conductor, and so any change in the position of the outer conductor (e.g. the change from cable screen to outer contact body) will alter the characteristic impedance.

A coaxial cable termination device which generally provides a much greater degree of impedance matching is manufactured and sold by Raychem Corporation of Menlo Park, Calif., USA and Raychem S. A of Cergy Pontoise, Paris, France, under the trade mark "PLUGPAK". This device utilises a tinned copper braid and a ring of solder located inside a heat recoverable sleeve in order to terminate the braid of a coaxial cable. In use, the sleeve is heated, causing it to shrink about the exposed braid of a coaxial cable inserted into the device, and causing solder ring to melt. Because its strands are relatively loosely braided, the tinned copper braid of the device is also able to shrink in diameter, and this normally eliminates the possibility of impedance mismatch at the termination, which may have arisen due to a change in the distance between the inner and outer conductors. However, the degree to which this shrinkage is possible is limited by the braid itself and the construction of the device, and it has been found that when relatively small diameter cables are terminated using this device, impedance mismatch may sometimes occur. There is therefore a need for a termination device which provides impedance matching whilst being able to terminate a greater range of cable sizes. More generally, there is also a continual need to improve upon the methods of terminating all types of screened wires and cables, and in particular to increase the reliability of their terminations in terms of screening effectiveness and grounding of the cable screen.

According to one aspect of the present invention, there is provided a device for terminating a cable having a screen and at least one inner: conductor, which comprises:

(i) a hollow electrically conductive outer body for terminating the screen of the cable, which has two open ends and which is provided with an internal screw thread that tapers from one of its open ends;

(ii) a metallic coil, at least part of which is screwed into the tapering screw thread of the outer body and tapers towards a constriction at least when screwed into the tapering screw thread; and (iii) a conformable metallic foil in tubular form, at least part of which is located within the constriction of the metallic coil;

the device being arranged so that the screen of the cable may be terminated by inserting an exposed portion of it into the tube of metallic foil and screwing the metallic coil further into the outer body by means of the tapering screw thread, thereby constricting the coil further and causing the metallic foil to tighten about the cable screen.

According to another aspect of the invention, there is provided a method of terminating a cable having a screen and at least one inner conductor by means of a device according to the invention, which comprises:

(i) inserting an exposed length of the cable screen into the tube of metallic foil; and (ii) screwing the metallic coil further into the outer body until the metallic foil has tightened about the exposed length of the cable screen.

According to a further aspect of the invention, there is provided a cable having a screen and at least one inner conductor, which is terminated by means of a device according to the invention. Preferably the cable is a coaxial cable.

The invention applies generally to cables which have a screen and at least one inner conductor, including screened multi-conductor cables and screened wires, but it is particularly applicable to coaxial cables.

The invention has a number of advantages. The device according to the invention may be used to terminate a range of cable sizes with improved impedance matching, because the metallic foil may be tightened about the cable screen of any one of a range of differently sized cables by screwing the metallic coil further into the outer body. It is possible to form a termination that is substantially impedance matched because the tube of metallic foil when tightened, provides a screen having an internal diameter which differs from that of the cable screen only by substantially the thickness of the cable screen itself. As well as improved impedance matching, the invention generally provides secure and reliable cable terminations because the metallic foil once tightened about the cable screen, forms an electrical connection with the cable screen that has a relatively low contact resistance, and the foil and the metallic coil together provide a degree of strain relief against bending.

The metallic foil may, for example, conform to, and be tightened about, a cable screen by being crushed by the metallic coil. Preferably however, the tube of metallic foil comprises a spiral wrap, wherein one portion of the foil overlaps another portion. This has an advantage in that, in use, constricting the coil further normally causes the spiral wrap of foil to tighten about a cable screen inserted into it. Additionally or alternatively, the metallic foil is preferably resiliently conformable. This has an advantage in that the resilience of the foil may be used to hold the foil in place prior to terminating a cable, since it may cause it to grip the constriction of the coil or the inside of the outer body.

The metallic foil may be formed from any appropriate metal, metal alloy or combination of metals or metal alloys, but preferably it is formed from copper, e.g. spring temper copper. In particular, it is preferred that the foil is formed from copper that has a layer of tin on at least one surface, and especially on both surfaces.

As mentioned above, screwing the metallic coil of the device further into the outer body by means of the tapering screw thread constricts the coil further. In its undeformed state, the metallic coil may have a generally right cylindrical shape, but it is preferred for it to taper in the same direction as the internal screw thread of the conductive outer body. This normally makes it easier to screw the coil further into the outer body, since less deformation of the coil is required. The coil is preferably resiliently deformable. This has an advantage in that if, subsequent to the formation of a termination, the coil is partly unscrewed from the tapering screw thread of the outer body, it will normally expand with the screw thread and therefore remain screwed into the outer body.

The metallic coil is preferably formed from metal wire, and the metal wire may generally have any cross-section which will enable the coil to be screwed into the conductive outer body. Preferably, however, the metal wire has a ridge extending along its length which provides the coil with an external screw thread. Most preferably the wire has a polygonal cross-section, and in this case at least one of the angled portions of the cross-section may form the ridge extending along the length of the wire.

The metallic coil may be formed from any appropriate metal, metal alloy or combination of metal or metal alloys, but preferably it is formed from copper, e.g. hard temper copper.

According to a preferred embodiment of the invention, at least part of both the metallic coil and the metallic foil are contained within an electrically insulating sleeve. More preferably, at least part of the electrically insulating sleeve of the device is dimensionally heat-recoverable. A dimensionally heat recoverable sleeve is an article which has a dimensional configuration which may be made substantially to change when subjected to heat treatment. Usually, such articles recover, on heating, towards an original shape from which they have previously been deformed, but the term 'heat-recoverable', as used herein, also includes articles which, on heating, adopt a new configuration, even if they have not previously been deformed.

The heat-recoverable sleeve may comprise a heat shrinkable article made from a polymeric material exhibiting the property of elastic or plastic memory as described, for example, in U.S. Pat. Nos. 2,027,962, 3,086,242 and 3,597,372. As is made clear in, for example, U.S. Pat. No. 2,027,962, the originally dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate stage.

Preferably the sleeve is attached to part of the metallic coil and is not attached to the outer body of the device, so that in use the sleeve may be twisted in order to screw the metallic coil further into the outer body and thereby tighten the metallic foil about the screen of the cable inserted into the device. Where the sleeve is dimensionally heat-recoverable, it may then be heated in order to cause it to recover about the coil and preferably also part of both the cable and the outer body of the device.

The sleeve is preferably formed from a polymeric material. Preferred materials include : low, medium or high density polyethylene; ethylene copolymers, e.g. with alpha olefins such as 1-butene or 1-hexene, or vinyl acetate; polyamides, especially Nylon materials, e.g. Nylon 6, Nylon 6.6, Nylon 11 or Nylon 12; and fluoropolymers, e.g. polytetrafluoroethylene, polyvinylidenefluoride, ethylene-tetrafluoroethylene copolymer or vinylidenefluoride tetrafluoroethylene copolymer.

According to another preferred embodiment of the invention, where the electrically insulating sleeve is dimensionally heat-recoverable, it contains a quantity of fusible polymeric material, preferably in the form of a ring, located beyond one end of the metallic coil. More preferably, the polymeric material is located such that, in use, when the sleeve is recovered the material will fuse between the sleeve and the outer jacket of a cable inserted into the device. The polymeric material so fused may help to seal the cable termination from moisture ingress and/or it may provide strain relief to the termination.

The fusible polymeric material according to the invention preferably comprises a hot-melt adhesive. The material may, for example, be formed from an olefin homopolymer or from a copolymer of an olefin with other olefins or ethylenically unsaturated monomers. Preferred examples include high, medium or low density polyethylene or ethylene copolymers with alpha olefins, especially C3 to C8 alpha olefins, vinyl acetate or ethyl acrylate. Alternatively, the material may be formed from polyamides, polyesters, halogenated polymers and the like. Preferred polyamides include those having an average of at least 15 carbon atoms between amide linkages, for example those based on dimer acids and/or dimer diamines. Examples of such adhesives are given in U.S. Pat. Nos. 4,018,733 to Lopez et al and 4,181,775 to Corke, the disclosures of which are incorporated herein by reference.

According to a further preferred embodiment of the invention a solder preform is located inside the electrically insulating sleeve, and more preferably, it is located about the metallic coil. The preform may have any one of a number of different shapes, but preferably it is either substantially annular or substantially frusto-conical.

In a particularly preferred embodiment of the invention, the solder preform comprises a length of solder in the form of a strip that has been wrapped into the shape of a ring so that one portion of the strip overlaps another portion. The formation of a solder ring by wrapping a strip or ribbon of solder about itself spirally has an advantage in that only a single solder feedstock is necessary for forming a range of solder ring sizes. Another advantage is that where a tapering metallic coil is used and the solder preform is located about the coil, and in use the coil is screwed further into the outer body, the solder preform wrap may unwind sufficiently to accommodate the windings of the coil which have a greater diameter than the windings about which the preform was originally located.

The device according to the invention may be heated in order to melt the solder preform, subsequent to tightening the metallic foil about the screen of a cable inserted into the device. Where the device includes a heat-recoverable sleeve, heating it may cause both the solder to melt and the sleeve to recover. At least some of the molten solder will normally flow through gaps between the windings of the metallic coil, and when the sleeve is heat-recoverable, the recovery of the sleeve will normally force most of the molten solder through these gaps. Therefore, when cooled and solidified, the solder will normally stiffen the metallic coil and strengthen the contact between the coil and the foil. In addition, for embodiments of the invention in which the metallic foil has a layer of tin on one or both surfaces, heating the device will normally cause the tin to melt, and when cooled the foil will therefore normally be bonded in its tightened arrangement about the cable screen and bonded to the screen itself.

The solder preform may be formed from any one or more appropriate solder compositions. For example, it may be formed from an $Sn_{63}$ $Pb_{37}$ eutectic composition which will melt as the device is heated. Alternatively, the solder preform may comprise a composite having a portion that is formed from a relatively high melting point solder, as described in International Publication No. WO88/09068. In this form of device, melting of the higher melting point component e.g. $Sn_{96.5}$ $Ag_{3.5}$ eutectic will normally provide a visual indication that the device has been heated sufficiently to melt the lower melting point component and to form a satisfactory solder joint. If desired, the lower melting point component may be of non- eutectic composition and, for example as described in International Publication No. WO90/09255, the higher and lower melting point components may together form a eutectic composition. For example, a non-eutectic $Sn_{60}$ $Pb_{40}$ lower melting point component may be employed with a higher melting point component formed from pure tin in relative amounts such that an $Sn_{63}$ $Pb_{37}$ eutectic is formed. The disclosures of these two patent applications are incorporated herein by reference. An advantage of employing a two component solder, and especially a tin, $Sn_{60}$ $Pb_{40}$ combination is that it reduces the possibility of 'wicking', that is to say, travel of the solder away from the joint area due to capillary action, which can be caused by prolonged heating of the device.

A particularly preferred embodiment of the invention is one which further comprises at least one inner electrical connector that is electrically insulated from the conductive outer body, for terminating the or each inner conductor of a cable. Any appropriate element for terminating the inner conductor(s) may serve as the electrical connector(s). The inner conductor(s) may, for example, be crimped, clamped, or soldered to the connector(s), but soldering is generally the preferred method since this normally produces the most robust and reliable type of termination. It is preferred for there to be a single inner electrical connector in the device. More preferably, this inner electrical connector comprises the central pin or socket of a coaxial connector, such as employed, for example, in BNC, TNC and SMA connectors and the like.

Preferably, the or each inner electrical connector contains at least one solder insert, for forming a soldered connection with the inner conductor(s). For example, the conductor(s) may have a hollow portion for receiving the inner conductor(s) of a cable inserted into the device, the hollow portion also containing a quantity of solder. The solder may be present in any appropriate form, for example as a ring, ball or pellet.

The or each inner electrical connector may advantageously contain at least one aperture for enabling the operator, in use, to determine whether or not the solder contained in the connector has been heated sufficiently for it to melt and form a solder connection with the conductor(s) of a cable. For example, where there is a single inner connector which comprises the central pin or socket of a coaxial connector, it may contain one or more apertures arranged transversally to the pin or socket. When the solder has melted and flowed, the operator may determine this by perceiving that either the solder has flowed away from the aperture(s) or that some of the solder has flowed into the aperture(s).

The or each inner electrical connector may additionally or alternatively contain resiliently deformable means for accommodating a range of sizes of inner conductor(s). The resiliently deformable means may comprise, for example, at least one strip of metal or at least one metallic coil (sometimes referred to as a 'stuffer coil') which is capable of being resiliently deformed by the insertion of the inner conductor(s) of a cable into the connector(s). The use of resiliently deformable means may have a number of advantages: firstly, it may help to retain the inner connector(s) prior to formation of a soldered connection; secondly, it may help to retain each solder insert inside the inner electrical connector(s) prior to melting of the solder; and thirdly, it may aid the flow of molten solder toward the inner conductor(s), by capillary action or 'wicking', thereby improving the soldered connection.

The or each electrical connector is electrically insulated from the outer body preferably by means of an electrical insulator which separates the connector(s) from the outer body. The insulator preferably comprises a body formed from a relatively rigid polymeric composition, such as for example polytetrafluoroethylene, high-density polyethylene or polyvinylidene fluoride.

A device according to the invention will now be described by way of example with reference to the accompanying drawings in which:

FIG. 1.is a section elevation along the axis of a device according to the present invention;

Figure 1:
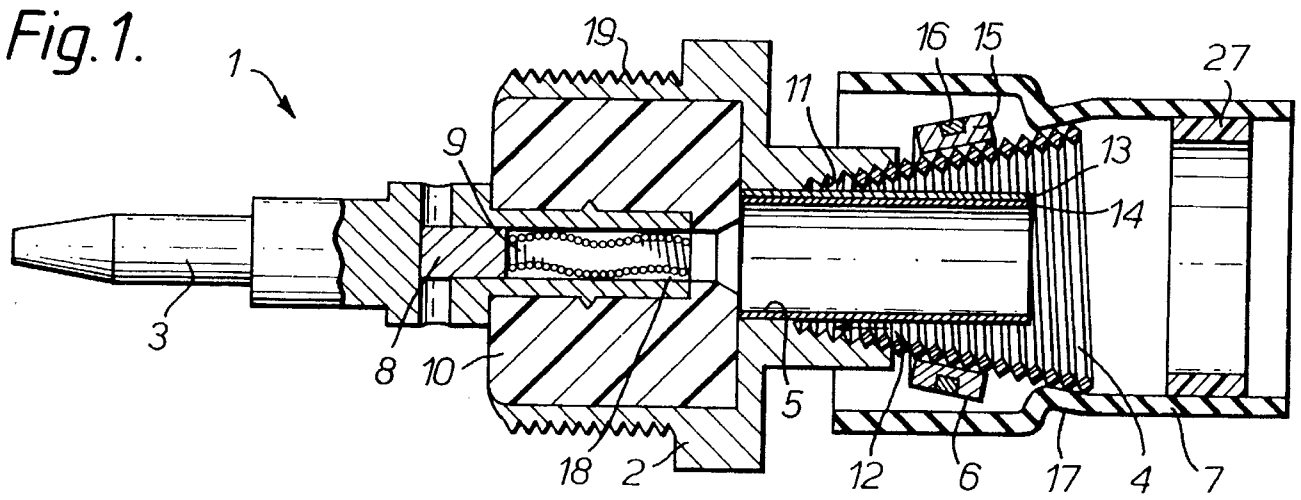

Referring to FIG. 1 of the accompanying drawings, a device 1 for terminating a coaxial cable comprises a hollow electrically conductive outer body 2, an inner electrical connector 3, a metallic coil, 4 a spirally wrapped strip of metallic foil 5, a solder preform 6, a heat-recoverable sleeve 7, a solder insert 8, a stuffer coil 9, an insulating body 10 and a fusible polymeric ring 27.

The conductive outer body 2, which is for terminating the screen of a coaxial cable, is formed from nickel plated brass. The outer body 2 has an internal screw thread 11 which tapers from an open end 12 of the outer body, and partly screwed into this tapering screw thread is the metallic coil 4. The coil 4 is formed from copper wire of square cross-section. Located partly inside the metallic coil 4 and partly inside the outer body 2 is the spirally wrapped strip of metallic foil 5. Two overlapping portions of the strip are indicated by 13 and 14. The foil 5 is formed from copper of spring temper and is tin plated on both surfaces.

Located about the metallic foil 5 is the solder preform 6. The preform 6 is substantially frusto-conical and is a composite strip comprising a portion 15 that is formed from $Sn_{63}$ $Pb_{37}$ (i.e. having a relatively low melting point) and a portion 16 that is formed from $Sn_{96}$ $Ag_4$ (i.e. having a relatively high melting point). The composite strip of the solder preform 6 has been wrapped into the shape of a frusto-conical ring so that one portion of the strip overlaps another portion (this feature is not illustrated in the drawings). The solder preform 6, together with the metallic coil 4, part of the outer body 2 and the fusible polymeric ring 27 are contained within the heat-recoverable sleeve 7. The sleeve 7 has been at least partially recovered about the coil 4 in the region indicated by 17. The sleeve is formed from cross-linked and expanded polyvinylidene fluoride.

Contained within the outer body 2 is the insulating body 10, which is formed from polytetrafluoroethylene. Located partly within the insulating body 10 is the inner electrical connector 3, which is for terminating the inner conductor of a coaxial cable, and is formed from gold plated brass. The connector 3 has a hollow portion 18, into which the inner conductor may be inserted, containing the stuffer coil 9 and the solder insert 8. The stuffer coil 9 is formed from tin-plated copper wire and the solder preform is formed from $Sn_{63}$ $Pb_{37}$.

The device shown in FIG. 1 may be attached to the body of one part of a coaxial connector, such as for example a BNC, TNC or SMA connector or the like. The conductive outer body 2 may, for example, be screwed into the back shell of the coaxial connector by means of the screw thread 19. The inner electrical connector 3 comprises the central male contact pin of the coaxial connector. In alternative versions of the device, the electrical connector 3 comprises the central female contact of the coaxial connector.

Figure 2:
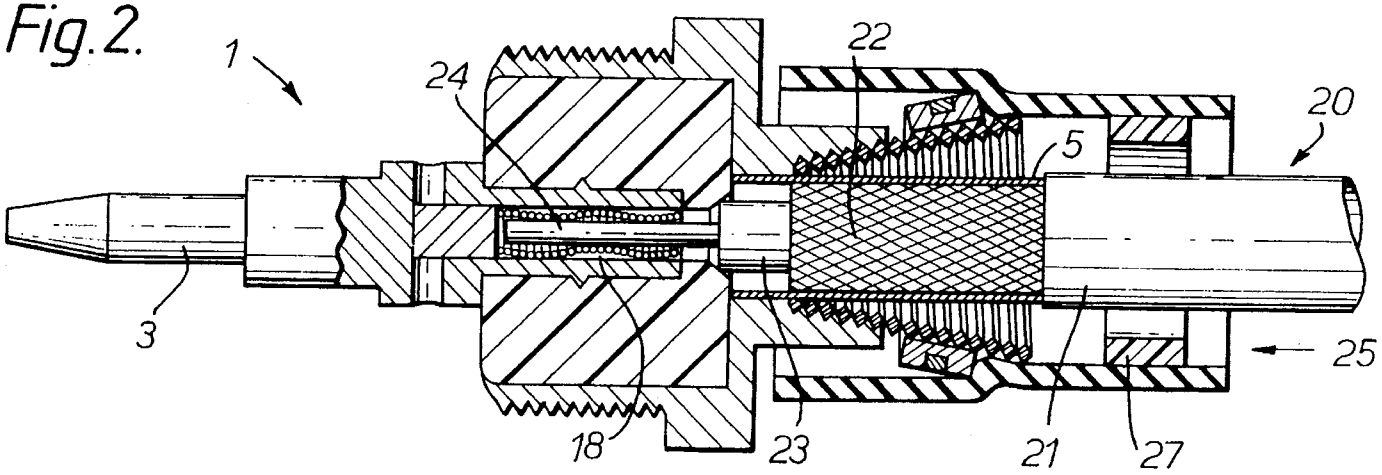
FIG. 2 is a sectional elevation along the axis of the device shown in FIG. 1, showing a coaxial cable inserted therein.

Referring now to FIG. 2, the end of a coaxial cable 20 is shown inserted into the device of FIG. 1. The end of the cable 20 has been prepared by the cable jacket 21, the cable screen 22 (a braid) and dielectric 23 having been cut back so as to expose appropriate lengths of the inner conductor 24, the dielectric and the screen. The end of the cable has been inserted into the device 1 through the open end 25 of the sleeve 7 and the ring of fusible polymeric material 27, so that an exposed length of the cable screen 22 has also been inserted into the spiral wrap of metallic foil 5 and most of the exposed length of the inner conductor 24 has been inserted into the hollow portion 18 of the inner connector 3. The metallic coil 4 has then been screwed further into the outer body until the spiral wrap of metallic foil 5 tightened about the exposed length of cable screen 22.

Figure 3:
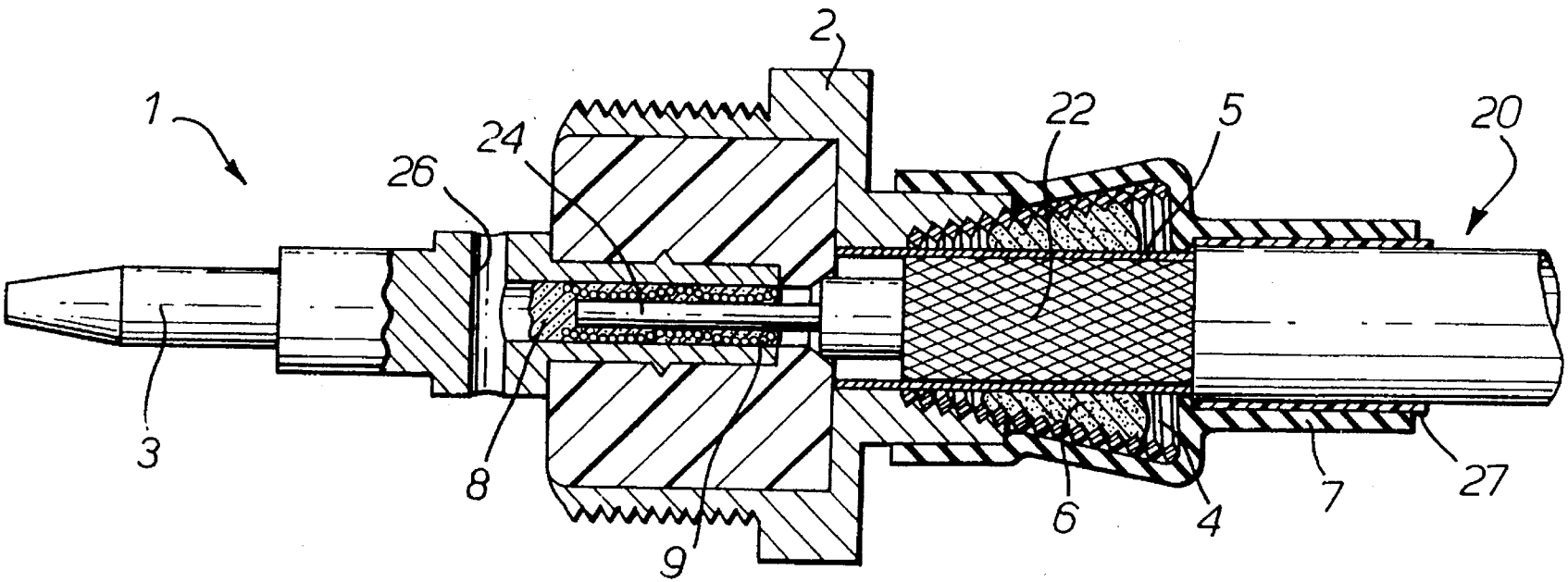
FIG. 3 is a sectional elevation along the axis of the device of FIGS. 1 and 2, showing a coaxial cable terminated therein.

FIG. 3 shows the device 1 of FIGS. 1 and 2 with the coaxial cable 20 of FIG. 2 terminated therein. The device 1 has been heated, subsequent to tightening the metallic foil 5 about the cable screen 22 as described above. Heating the device 1 has caused the solder preform 6, the solder insert 8 and the ring of fusible polymeric material 27 to melt and the sleeve 7 to recover about the metallic coil 4, the cable 20 and the outer body 2.

The melting of the solder insert 8 has caused a soldered connection to be formed between the inner conductor 24 of the coaxial cable 20 and the inner electrical connector 3. The molten solder insert has flowed into the spaces between the stuffer coil 9, the inner conductor 24 and the inner connector 3 due to capillary action, and in so doing has flowed away from the aperture 26, thereby allowing the operator to determine whether or not the device has been heated sufficiently to form the soldered connection.

The recovery of the sleeve 7 about the coil 4 has forced most of the molten solder of the preform 6 between gaps in the coil and a soldered connection has therefore been formed between the coil and the metallic foil 5. The applied heat has also melted the tin which was plated on both surfaces of the metallic foil 5 and therefore the foil wrap has been bonded in its tightened arrangement about the screen 22 of the cable and has also been bonded to the screen itself. The operator has been able to determine that sufficient heat has been applied to the device 1 in order for these processes to take place by observing the disappearance of the profile of the solder preform 6 under the recovered sleeve 7. In particular, the disappearance of the profile of the relatively high melting point portion 16 of the composite solder preform has indicated that the lower melting point solder portion 15 has fully melted and flowed.

The recovery of the sleeve 7 about the jacket 21 of the cable 20 has caused the molten polymeric material 27 to fuse between the cable jacket and the sleeve. This has provided additional strain relief to the termination and has sealed the termination against moisture ingress.

Figure 4:
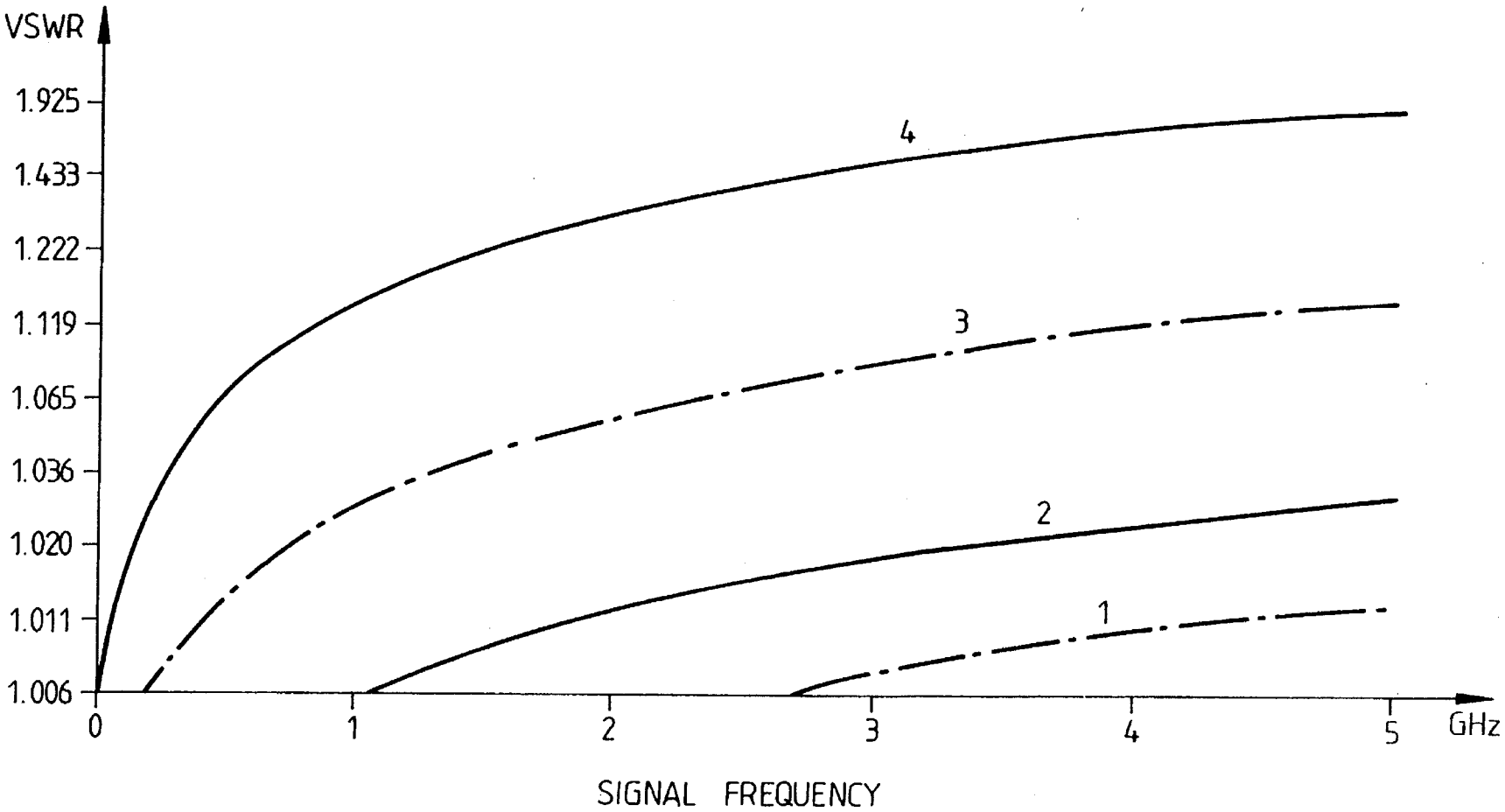
FIG. 4 is a graph showing Voltage Standing Wave Ratio (VSWR) against signal frequency as calculated for a device according to the invention and a prior art cable termination.

Referring now to FIG. 4, this shows graphs of calculated (i.e. estimated) Voltage Standing Wave Ratio (VSWR) against Signal Frequency for two sizes of coaxial cable (RG316 and RG178) and for a device according to the invention and a PLUGPAK (trademark) termination device (as mentioned above). Each of graphs 1 to 4 represents the variation in calculated VSWR with signal frequency for the devices and cables as follows:

Graph 1. A device according to the invention installed on RG316 cable.

Graph 2. A PLUGPAK device installed on RG316 cable.

Graph 3. The device of graph 1 installed on RG178 cable.

Graph 4. The device of graph 2 installed on RG178 cable.

The graphs show that for each size of cable, the device according to the invention exhibits smaller calculated VSWR than the PLUGPAK device over the signal frequency shown. It also shows that for smaller diameter cables (e.g. RG178 as shown) the device according to the invention exhibits a significant reduction in calculated VSWR compared to the PLUGPAK device. This is an illustration of the improved ability of the device according to the invention substantially to provide impedance matching for a range of cable sizes.

For example, at a signal frequency of 4 GHz, the calculated VSWR of each device for a given cable size is:

Graph 1 (Device according to the invention on RG316): 1.01

Graph 2 (PLUGPAK device on RG316): 1.02

Graph 3 (Device according to the invention on RG178): 1.11

Graph 4 (PLUGPAK device on RG178): 1.66

The graphs and values of VSWR were calculated on computer from a model of the electrical performance (in terms of VSWR) of the termination of the screen (only) of each coaxial cable by the respective termination device.

In the calculations of VSWR, the following mathematical formulae were used:

$$VSWR = \frac{1+R}{1-R}$$

where R is the complex reflection, defined as:

$$R = \frac{Z - Zo}{Z + Zo}$$

where Z is the estimated impedance of the device at the cable screen termination and Zo is the characteristic impedance of the cable.

I claim:

1. A device for terminating a cable having a screen and at least one inner conductor, which comprises:

(i) a hollow electrically conductive outer body for terminating the screen of the cable, which body has two open ends and which is provided with an internal screw thread that tapers from one of its open ends;

(ii) a metallic coil, at least part of which is screwed into the tapering screw thread of the outer body and tapers towards a constriction at least when screwed into the tapering screw thread; and (iii) a conformable metallic foil in tubular form, at least part of which is located within the constriction of the metallic coil;

the device being arranged so that the screen of the cable may be terminated by inserting an exposed portion of it into the tube of metallic foil and screwing the metallic coil further into the outer body by means of the tapering screw thread, thereby constricting the coil further and causing the metallic foil to tighten about the cable screen.

2. A device as claimed in claim 1, wherein the metallic coil tapers in the same direction as the internal screw thread of the conductive outer body.

3. A device as claimed in claim 1, wherein the metallic coil is resiliently deformable.

4. A device as claimed in claim 1, wherein the metallic coil is formed from metal wire which has a ridge extending along its length which provides the coil with an external screw thread.

5. A device as claimed in claim 1, wherein the tube of metallic foil comprises a spiral wrap, wherein one portion of the foil overlaps another portion.

6. A device as claimed in claim 1, wherein the metallic foil is resiliently conformable.

7. A device as claimed in claim 1, wherein at least part of the metallic coil and at least part of the metallic foil are contained within an electrical insulating sleeve.

8. A device as claimed in claim 7, wherein at least part of the sleeve is dimensionally heat-recoverable.

9. A device as claimed in claim 7, wherein a solder preform is located inside the sleeve.

10. A device as claimed in claim 8, wherein the sleeve contains a quantity of fusible polymeric material located beyond one end of the metallic coil.

11. A device as claimed in claim 1, which further comprises at least one inner electrical connector that is electrically insulated from the conductive outer body, for terminating the or each inner conductor of the screened cable.

12. A device as claimed in claim 11, wherein the or each inner electrical connector contains at least one solder insert.

13. A device as claimed in claim 12, wherein the or each inner electrical connector contains resiliently deformable means for accommodating a range of sizes of inner conductor(s).

14. A device as claimed in claim 13, wherein the resiliently deformable means comprises a metallic coil.

15. A cable having a screen and at least one inner conductor, which is terminated at at least one of its ends by means of a device as claimed in claim 1.

16. A method of terminating a cable having a screen and at least one inner conductor by means of a device as claimed in claim 1, which comprises:

(i) inserting an exposed length of the cable screen into the tube of metallic foil; and (ii) screwing the metallic coil further into the outer body until the metallic foil has tightened about the exposed length of the cable screen.

* * * * *